United States Patent [19]

Hall

[11] Patent Number: 4,531,733

[45] Date of Patent: Jul. 30, 1985

[54] FASTENER AND BASE USING SAID FASTENER

[76] Inventor: Roger E. Hall, 100 Lakeview Dr., Elizabethtown, Pa. 17022

[21] Appl. No.: 472,241

[22] Filed: Mar. 4, 1983

Related U.S. Application Data

[60] Continuation-in-part of Ser. No. 395,279, Jul. 6, 1982, abandoned, which is a continuation of Ser. No. 234,618, Feb. 17, 1981, abandoned, which is a division of Ser. No. 18,844, Mar. 8, 1979, Pat. No. 4,266,768, which is a continuation-in-part of Ser. No. 758,638, Jan. 12, 1977, abandoned.

[51] Int. Cl.[3] ..... A63B 71/00

[52] U.S. Cl. ..... 273/25; 24/297; 24/573; 24/602; 24/444; 24/449; 24/452; 24/305; 446/121

[58] Field of Search ..... 273/25; 24/204, 289, 24/297, 573; 46/30, 31, 25, 26

[56] References Cited

U.S. PATENT DOCUMENTS

| | | | |
|---|---|---|---|
| 1,244,044 | 10/1917 | Falconer | 273/25 |
| 2,084,775 | 6/1937 | Orefice | 273/25 |
| 2,695,784 | 11/1954 | Orsatti et al. | 273/25 |
| 2,937,834 | 5/1960 | Orenick et al. | 248/71 |
| 2,947,540 | 8/1960 | Henry | 273/25 |
| 3,126,203 | 3/1964 | Bourret | 273/25 |
| 3,176,364 | 4/1965 | Dritz | 24/213 |
| 3,204,958 | 9/1965 | Velasquez | 273/25 |
| 3,266,113 | 8/1966 | Flanagan, Jr. | 24/204 |
| 3,408,705 | 11/1968 | Kayser et al. | 24/204 |
| 3,471,903 | 10/1969 | Northrup et al. | 24/73 |
| 3,505,772 | 4/1970 | Claire et al. | 52/511 |
| 3,508,747 | 4/1970 | Orsatti | 273/25 |
| 3,862,756 | 1/1975 | Selliken | 273/25 |
| 3,895,804 | 7/1975 | Lee | 273/282 X |
| 4,216,257 | 8/1980 | Schams et al. | 428/93 |
| 4,266,768 | 5/1981 | Hall | 273/25 |
| 4,290,174 | 9/1981 | Kalleberg | 24/204 |
| 4,322,875 | 4/1982 | Brown et al. | 24/204 |
| 4,398,715 | 8/1983 | Hall | 273/25 |

*Primary Examiner*—Richard C. Pinkham
*Assistant Examiner*—T. Brown
*Attorney, Agent, or Firm*—Kerkam, Stowell, Kondracki & Clarke

[57] ABSTRACT

A fastener includes a pad element having number of connecting prongs having two locking ridges disposed thereon. The top locking ridges, which are disposed closest to the tip of the prongs, are smaller than the lower locking ridges, thereby facilitating easy alignment of the unisex fasteners of a mating pad. Back prongs on the pad are used for connecting the pad to a surface of an article having holes for receiving the back prongs such that the connecting prongs are positioned to face upwardly from the surface. The fastener is adapted for use in yieldably or separably anchoring a baseball base in place on a playing field ground support attachment having like-constructed fastener prongs whereby injury to a runner sliding into the base will be minimized due to yielding under a relatively low force or separating under a relatively high force of the fastener prongs upon contact thereof.

25 Claims, 22 Drawing Figures

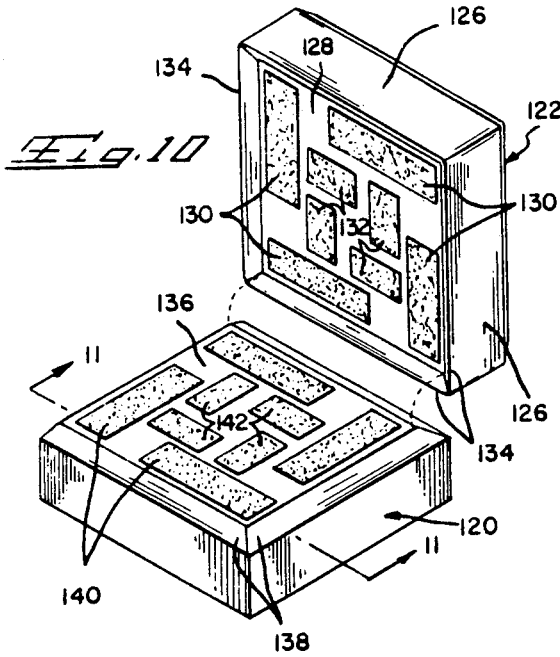
Fig. 10
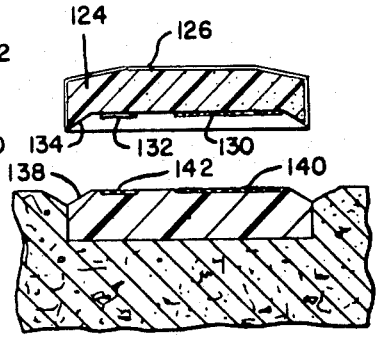
Fig 11
Fig. 12A
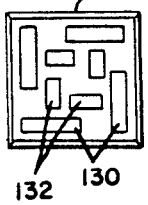
Fig. 12B
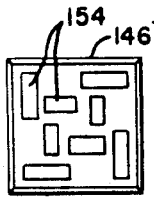
Fig. 12C
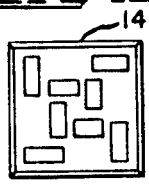
Fig. 12D
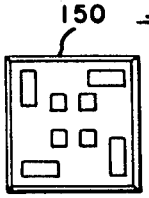
Fig. 12E
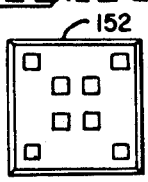
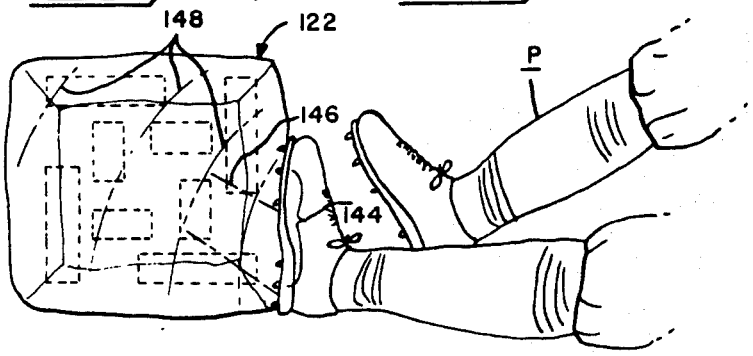
Fig. 13

FASTENER AND BASE USING SAID FASTENER

CROSS-REFERENCE TO RELATED APPLICATIONS

This application is a continuation-in-part of my copending application for Breakaway Safety Base Serial No. 395,279 filed July 6, 1982 (abandoned) which is a continuation of Ser. No. 234,618 filed Feb. 17, 1981 and now abandoned. Ser. No. 234,618 was a divisional application of Ser. No. 018,844 filed Mar. 8, 1979 now issued as U.S. Pat. No. 4,266,768 on May 12, 1981. Ser. No. 018,844 was in turn a continuation-in-part of Ser. No. 758,638 filed Jan. 12, 1977 and now abandoned. These applications and patent are hereby incorporated by reference.

FIELD OF THE INVENTION

This invention relates to a fastener for joining two elements comprising a number of prongs on one element which mate and lock with like constructed prongs on the other element. More particularly, this invention relates to fasteners for separable elements such as, for example, a base for baseball or other sport devices which use the fastener to anchor the device and become readily separable therefrom upon physical contact of a participant with the device.

DESCRIPTION OF THE PRIOR ART

Numerous types of fasteners having resilient prongs have heretofore been known. For example, the following patents disclose such fasteners:

| U.S. Pat. No. | Inventor(s) | Date Issued |
|---|---|---|
| 2,937,834 | Orenick et al | May 24, 1960 |
| 3,176,364 | Dritz | April 6, 1965 |
| 3,266,113 | Flanagan, Jr. | Aug. 16, 1966 |
| 3,408,705 | Kayser et al | Nov. 5, 1968 |
| 3,471,903 | Northrup et al | Oct. 14, 1969 |
| 3,505,772 | Claire et al | Apr. 14, 1970 |
| 4,216,257 | Schams et al | Aug. 5, 1980 |
| 4,290,174 | Kalleberg | Sept. 22, 1981 |
| 4,322,875 | Brown et al | April 6, 1982 |

The Orenick et al. patent discloses a cable fastener including a male connector having a locking ridge which inserts into a socket including an internal ridge for gripping to the locking ridge of the male member. The socket additionally includes an external ridge which allows it to be locked into a hole in a planar surface.

The Dritz patent shows numerous embodiments for a separable fastener including an embodiment in FIG. 31 having alternating annular ridges and depressions.

The Northrup et al. patent shows a fastener including a number of headed elements for fastening to a like constructed fastener which may also include studs disposed on the back of the fastener for attaching the fastener to holes in a panel.

The Claire et al. patent discloses a fastening arrangement wherein a fastener having headed prongs connects into a fastener having sockets on one side and two wedges on its opposite side for holding the fastener into holes in a panel.

The Flanagan patent describes numerous fastener embodiments having locking ridges on prongs. An embodiment in FIGS. 6*a* and 6*b* has two locking ridges and uses a substrate having depressions therein for receiving the tip of prongs from an attached fastener.

The Kayser et al. fastener includes a disclosure of fasteners having different shaped prongs for locking on to an attached fastener.

The Schams et al., Kalleberg, and Brown et al. patents all disclose fasteners including headed prongs made from U-shaped monofilaments.

The prior art further discloses the use of anchoring devices for baseball bases. The following patents are illustrative:

| U.S. Pat. No. | Inventor(s) | Date Issued |
|---|---|---|
| 1,244,044 | Falconer | Oct. 23, 1917 |
| 2,084,775 | Orefice | June 22, 1937 |
| 2,695,784 | Orsatti et al | Nov. 30, 1954 |
| 2,947,540 | Henry | Aug. 2, 1960 |
| 3,126,203 | Bourret | March 24, 1964 |
| 3,204,958 | Velasquez | Sept. 7, 1965 |
| 3,508,747 | Orsatti | April 28, 1970 |
| 3,862,756 | Selliken | Jan. 25, 1975 |

The Falconer patent discloses a baseball base mounted into a group support by a spring such that the base will permit limited lateral movement.

The Orefice patent discloses a baseball base having a number of spikes holding a ground support plate into the ground. The baseball base may then be strapped to the ground support.

The Henry patent discloses a baseball base including a plurality of radially extending springs for allowing limited movement of the base.

The Bourret patent shows a baseball base having a centrally disposed pipe which extends into a sleeve member buried in the ground.

The Velasquez patent discloses a baseball base having a tubular ground support and springs which allow the base to yield with respect to the lower ground support.

The Orsatti patent and the Orsatti et al. patent both disclose baseball base anchoring devices having lower ground supports and tubes which extend therein.

The Selliken patent discloses an anchored plate member with a base member being attached thereto by magnetic elements which allows the base member to be separated from the plate upon violent impact therewith by a baseball player.

Other patents disclose various forms of fasteners for devices used in sports. For example, U.S. Pat. No. 3,198,525 issued to Smith on Aug. 3, 1965 discloses a golf putter having a magnetically attached sighting element, whereas U.S. Pat. No. 3,273,891 to Grim on Sept. 20, 1966 shows a sighting mirror attached to a golf club by an adhesive material such as VELCRO.

Although prior art fasteners using prongs have been generally useful in performing their intended function, they are often subject to one or more of a number of disadvantages. For example, some of these fasteners have limited holding capabilities and do not sufficiently resist pulling apart when subjected even to separating forces. Alternately, other fasteners are extremely difficult to pull apart unless pulled directly perpendicular to the plane in which two fasteners are attached. Other fasteners, such as plastic adhesive materials may degrade in the sun when used outdoors due to reaction of ultra violet rays. Additionally, water may damage or destroy the fastening ability of various prior art fasteners. Prior art fasteners which use prongs often have a tendency for the prongs to either be too rigid at their tips making the fastening operation somewhat difficult or too flexible at their bases such that the fastener has insufficient holding power. Often, prior art fastening devices commonly require extensive periods of time to fasten or unfasten. Thus, because of the many interdependent features of prong fasteners, such fasteners are usually designed for a specific application and cannot be used universally in a wide variety of applications.

Numerous baseball bases which are adapted to yield under lateral force have heretofore been known. Two alternate approaches suggest the use of springs or magnets. Those prior art bases which use springs are disadvantageous in that the spring or springs will tend to deform after long periods of use. This may cause the displacement of the base from its proper position. Although stronger springs might minimize this problem, such stronger springs may prevent the base from yielding sufficiently to avoid injury to the sliding baseball runner. The spring-biased bases, as well as the magnetically secured prior art bases, are also disadvantageous in that metallic parts such as springs and magnets may rust and lose their efficiency with time. Further, with magnets, dirt which collects between the faces of the magnetic pieces tends to reduce its effectiveness.

SUMMARY OF THE INVENTION

Accordingly, it is a primary object of the present invention to provide a new and improved fastener.

A further object of the present invention os to provide a fastener having relatively strong holding power, but whose fastened elements may be quickly engaged and disengaged.

A further object of the present invention is to provide a fastener which is waterproof and resistant to degradation with age.

Yet another object of the present invention is to provide a fastener which will allow the fastened elements to yield slightly under low force and will sever their connection under high force.

A still further object of the present invention is to provide an athletic contact device, such as a base, which will yield slightly to an athlete under low amounts of applied force and spring back to a normal position, but will sever its connection with its support under higher amounts of applied force.

A further object of the present invention is to provide an improved attachment arrangement between a base and a lower ground support.

Yet another object of the present invention is to provide a base which is easily attached and unattached from a lower ground support.

These and other objects of the present invention which will become apparent as the description proceeds are realized by an invention comprising a fastener including a first substrate with first and second surfaces on opposite sides thereof, and a plurality of resilient connecting prongs projecting from the first surface. Each connecting prong includes a peripherally extending top locking ridge, a peripherally extending bottom locking ridge, a peripherally extending upper recess disposed between the top locking ridge and the bottom locking ridge, and a peripherally extending lower recess disposed between the bottom locking ridge and the first surface. The bottom locking ridge is larger than the top locking ridge and the lower recess is larger than the upper recess. The first surface is planar and the prongs form a unisex element adapted to fasten to like constructed prongs with top locking ridges of the prongs a first substrate locked to bottom locking ridges of the prongs on a second substrate. The first substrate further includes a plurality of back prongs projecting from its second surface, each back prong having a peripherally extending locking ridge and a peripherally extending recessed portion and is adapted to be mounted to a face of an article with the second surface conforming to the face and each back prong locking ridge locking its back prong in a hole in the face. The invention further comprises an article having a face and having the first fastener mounted to the face with each back prong locked in a hole in the face by its locking ridge. Each of the connecting prongs is rotationally symmetric and each prong includes a tapered head portion and a peripherally extending substrate ridge disposed between the lower recess and the first surface. The bottom locking ridge of each prong is tapered downwardly and outwardly.

The invention further comprises an athletic contact device such as, for example, a base member having the first fastening element attached thereto and a lower ground support having a second fastening element attached thereto. The second fastening element has the same construction as the first fastening element, and the two elements together form the fastener. The first and the second fastening elements are attached together to secure the base member to a lower ground support and are arranged such that the base member will totally sever from its support when the base member is subject to a lateral force greater than an injury potential threshold lateral force. The base member has a lower surface with a peripheral portion slanted up and inwardly and the ground support has a peripheral portion slanted up and inwardly for mating with the peripheral portion of the base member.

BRIEF DESCRIPTION OF THE DRAWINGS

The invention will be understood by consideration of the following detailed description of the invention in conjunction with the accompanying drawings in which like numbers represent like parts throughout the several views and in which:

FIG. 10 is a perspective view of another embodiment of a breakaway safety base;

FIG. 11 is a sectional view taken generally along the line 11—11 of FIG. 10 showing the ground support mounted on a playing field with the base above the ground support;

FIGS. 12A, 12B, 12C, 12D and 12E are views of the lower mounting surfaces of bases for use with a common ground support to provide different breakaway forces;

FIG. 13 illustrates the impact of the player against a base of the type shown in FIG. 10;

DETAILED DESCRIPTION OF THE INVENTION

Figure 1:
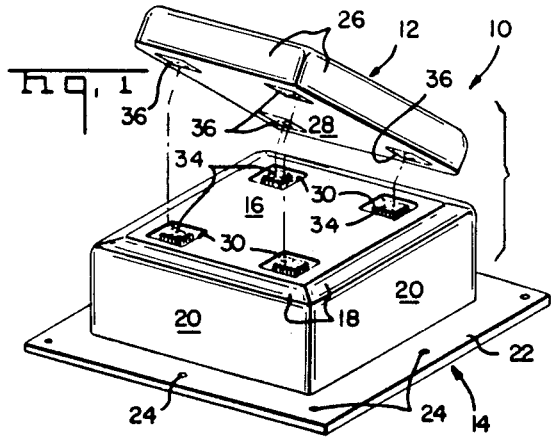
FIG. 1 is a perspective view of a safety base.
Figure 2:
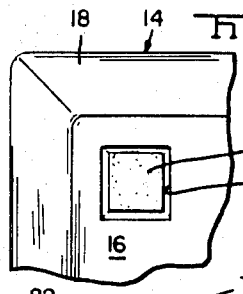
FIG. 2 is an enlarged, partially broken away view of one corner of the support plate.
Figure 6A:
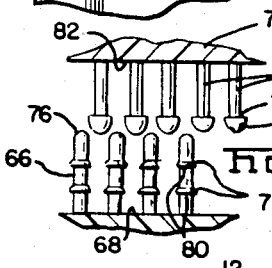
FIGS. 6 and 6A are views similar to FIG. 5 but illustrating different elements.
Figure 3:
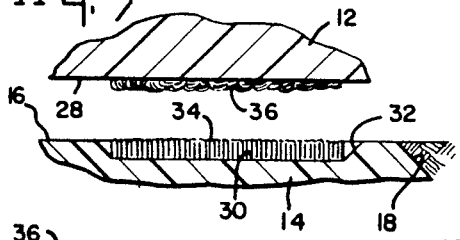
FIG. 3 is a cross-sectional side view showing mounting elements on the base and support plate.
Figure 4:
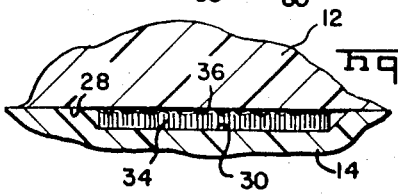
FIG. 4 is like FIG. 3 showing the mounting elements secured to each other.
Figure 5:
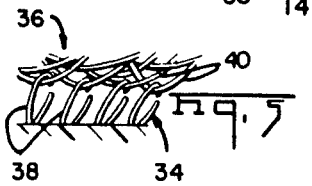
FIG. 5 is an enlarged view of the mounting elements illustrating the engagement between the elements.
Figure 6:
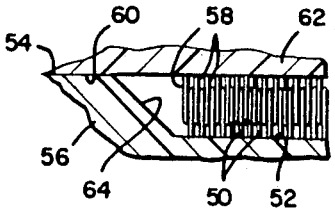
Figure 7:
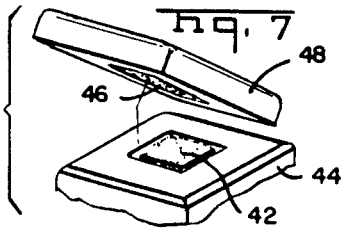
FIG. 7 is a perspective view similar to FIG. 1 of a different embodiment.
Figure 9:
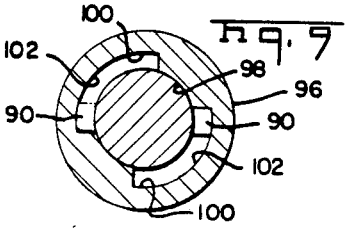
FIG. 9 is a sectional view taken along line 9—9 of FIG. 8.
Figure 8:
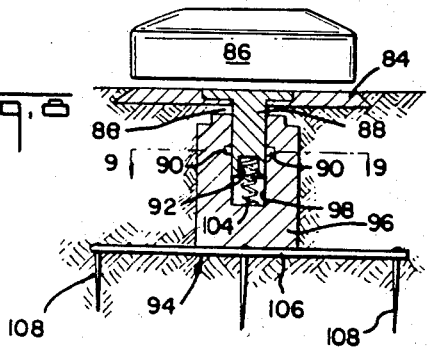
FIG. 8 is a sectional view of a safety base with an improved releasable mounting device for one support.
Figure 15:
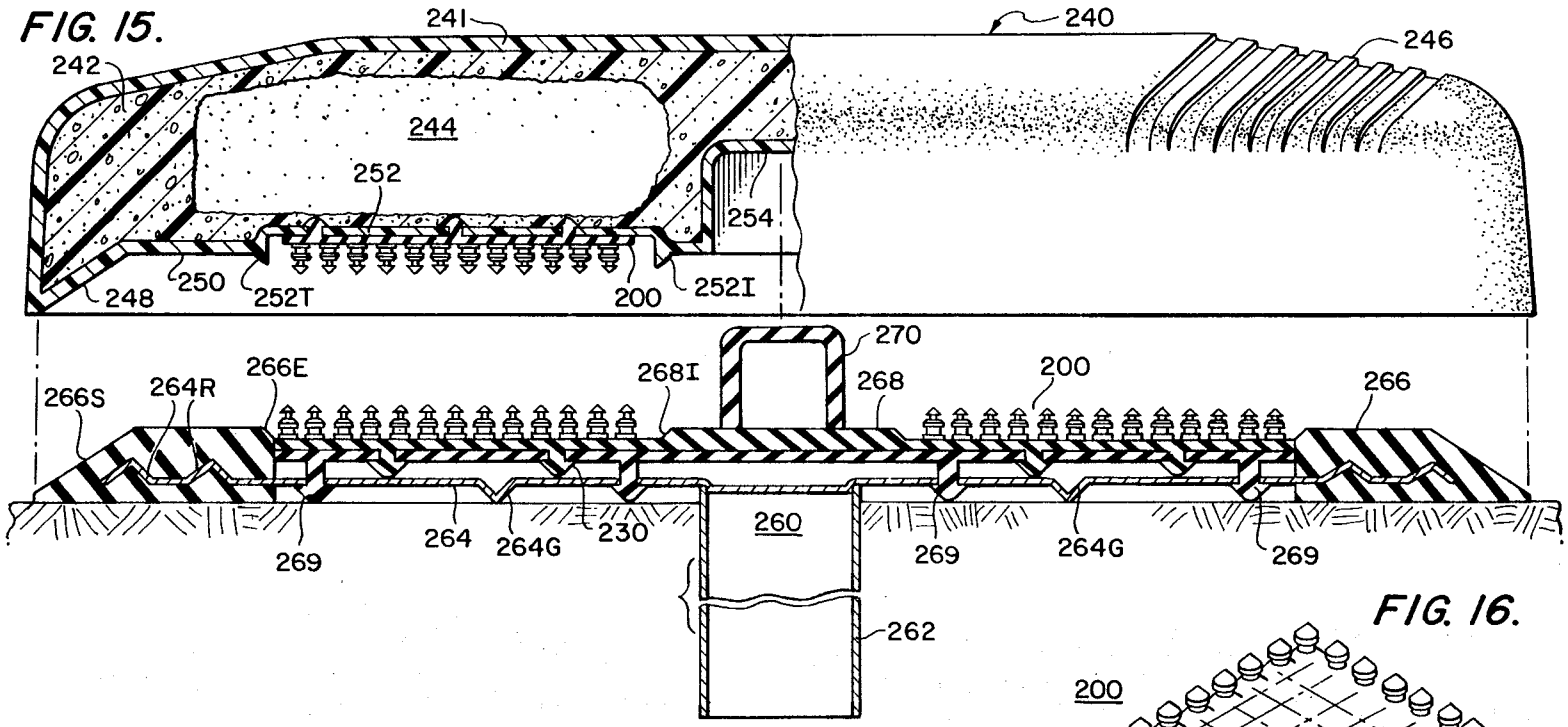
FIG. 15 shows a cross-sectional side view of a base member and ground support according to an embodiment of the present invention.

FIGS. 1–13 correspond to the like numbered figures of the parent applications and U.S. Pat. No. 4,266,768. Accordingly, these figures need not be discussed in detail herein. However, it is noted that FIG. 6A discloses a lower surface 82 of a base including prongs 70 having locking ridges 74 which can lockingly engage with spaced locking ridges 80 on prongs 78 extending from ground support 68. Further, the present invention contemplates the use of fasteners in the arrangements of FIGS. 12A–12F, although a preferred arrangement is shown in FIG. 15.

Figure 14B:
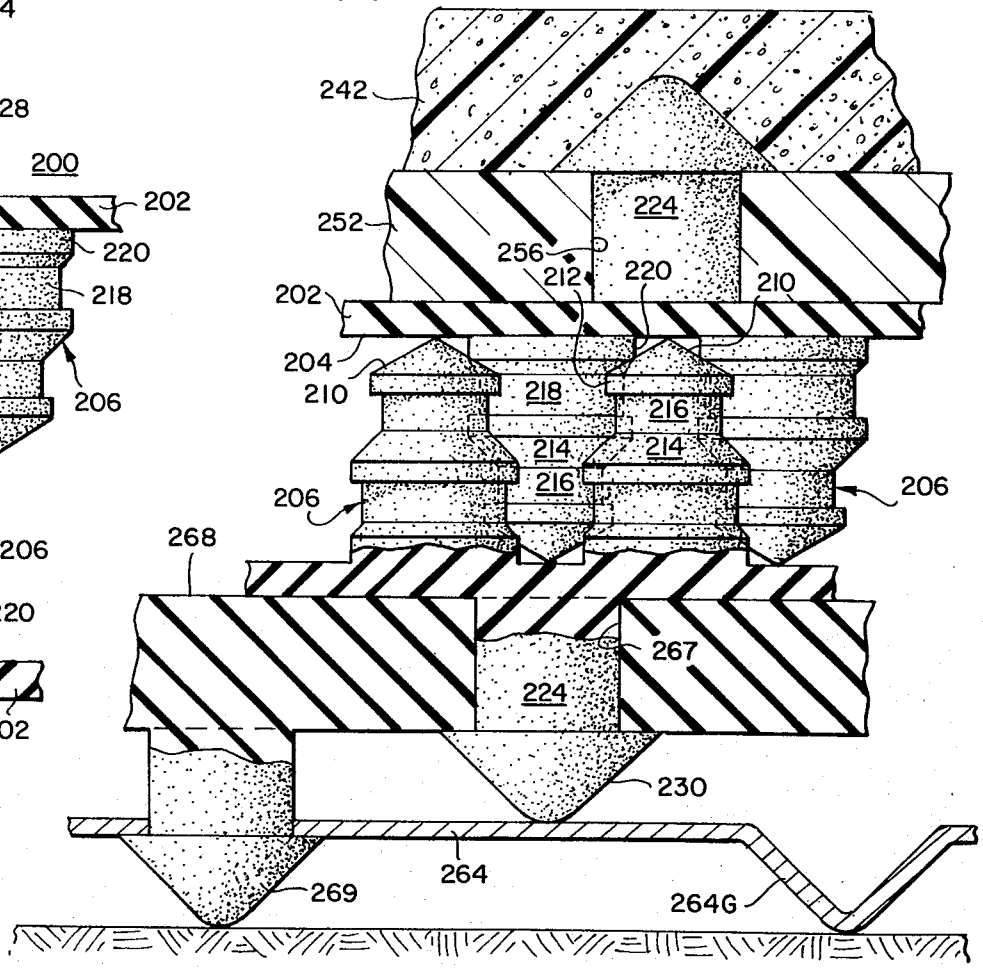
FIGS. 14A and 14B show fasteners according to an embodiment of the present invention in respectively unfastened and fastened conditions.
Figure 14A:
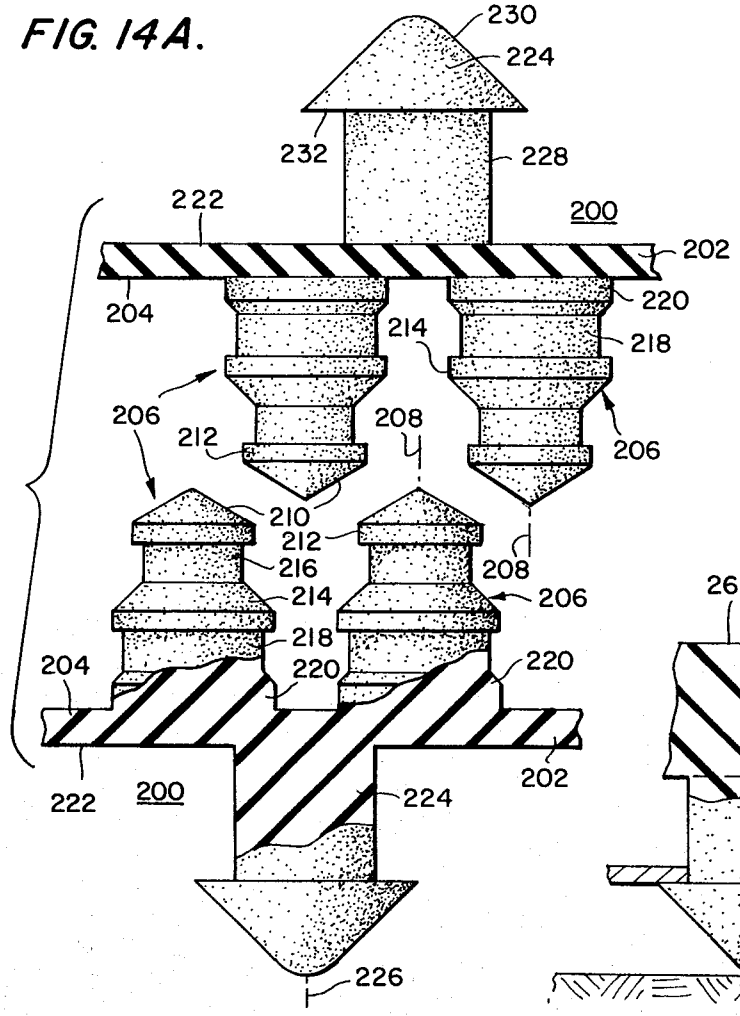

FIG. 14A shows a side view in partial cross section of two mating fastening elements 200 which form a fastener and which illustrate a preferred embodiment of the fastener of the present invention. Each fastening element 200 includes a substrate or backing sheet 202 and prongs 206 preferably made of rubber or similar resilient material arranged in a matrix of rows and columns.

Mounted on a first surface or front 204 of substrate 202 are a plurality of connecting prongs 206. For each of illustration, the parts of the prongs 206 are not all numbered, since all prongs 206 are constructed identically. Each of the prongs 206 is rotationally symmetric about a central axis 208 meaning that any intersection between a plane perpendicular to axis 208 and the prong 206 will be a circle. The prong 206 includes a tapered head portion 210 and a peripherally extending top locking ridge 212. ("Top" or "upper" as used herein shall refer to that portion of prong 206 relatively distant from substrate 202, whereas "bottom" or "lower" shall refer to the portion of prong 206 relatively close to substrate 202). A bottom locking ridge 214 is separated from the top locking ridge 212 by an upper recess 216. A substrate ridge 220 is disposed at the base of the prong 206 just above the substrate 202 and is separated from the bottom locking ridge 214 by the lower recess 218. Both the bottom locking ridge 214 and the substrate ridge 220 include upper portions which are tapered down and outwardly for ease of operation as will be discussed below. The tapered head portion 210 tapers into the top locking ridge 212. As shown in FIG. 14A (and FIG. 14B), the bottom locking ridges 214 are larger than the top locking ridges 212 and the lower recesses 218 are larger than the upper recesses 216.

On the back or second surface 222 of substrate 202 is a back prong 224 which is rotational symmetric about a central axis 226. The back prong 224 includes a peripherally extending recessed portion 228 and a tapered head portion 230 defining a peripherally extending locking edge 232.

Figure 16:
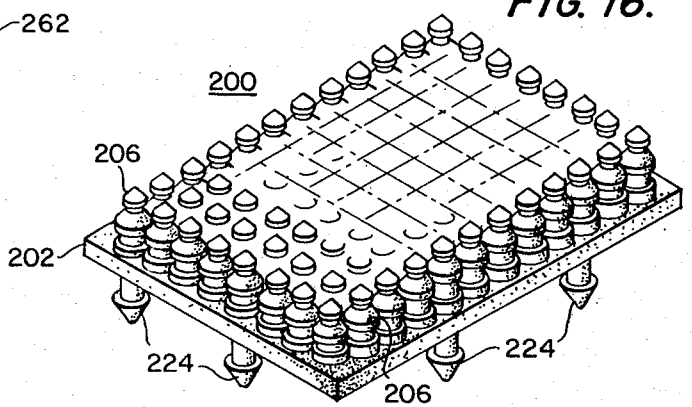
FIG. 16 shows a perspective view of a fastening element according to an embodiment of the present invention.

The fastening element 200 is preferably made of rubber with the front prongs 206 and back prongs 224 integrally molded with substrate 202 to form a rectangular array as shown in the perspective view of FIG. 16.

The operation of the fastener will now be discussed with reference to FIGS. 14A, 14B, and FIG. 16. FIG. 14B shows a side view in partial cross section of the fastening elements 200 fastened together. In order to fasten the two elements 200, they are placed with their prongs 206 facing each other. Because the top locking ridge 212 of each prong will readily clear the top locking ridges 212 of the prongs 206 of the other element, the prongs will readily fit together in a semi-locked state whereby the tapered head portion 210 of each prong 216 will rest in contact with the tapered portions of bottom locking ridge 214. This state is semi-locked in that the elements 200 will offer no resistance to separation if separating force is applied in parallel to the central axes 208 of all of the prongs 206. However, if lateral force is applied, the contact between the tapered head portion 210 and the tapered portion of lower locking ridge 214 will tend to resist lateral movement of one element relative to another.

Once the prongs of a fastener are in this semi-locked state with the tapered head portions 210 contacting the tapered portions of bottom locking ridges 214, the coacting prongs may be readily locked together or brought into complete engagement; by pushing one element towards the other such that each tapered head portion 210 and associated top locking ridge 212 will clear the bottom locking ridges 214 of the prongs adjacent thereto. In the locked or attached state shown in FIG. 14B, the tapered head portion 210 is seated next to the substrate ridge 220 of opposing prongs and each prong's top locking ridge is seated next to the lower recess of the opposing prongs and held therein by the bottom locking ridge of the opposing prongs. The tapered portion of bottom locking ridge 214 of each prong is now seated next to the tapered portion of bottom ridge 214 of the opposing prongs with the annular or non-tapered portion of bottom locking ridge 214 seated next to the upper recess 216 with its bottom locking ridge 214 locking to the top locking ridges 212 of the opposing prongs. When disposed in the locked state each prong 206 is squeezed inwardly by the opposing prongs contacting therewith.

As will best be appreciated by considering FIG. 16, which shows a perspective view of a fastener 200, most of the prongs of a fastening element, i.e. all but the prongs of the outermost rows and columns, will be disposed in between four opposing prongs when the opposing elements are fastened.

The back prongs 224 of fastening element 200 are used for attaching the fastening element 200 to a surface of an article having a hole for insertion of tapered head portion 230 such that locking edge 232 will hold the second or back surface 222 of the substrate 202 to a surface of the article. FIG. 14B shows the back prongs 224 of opposing fastening elements connected to hole 256 and 267 in respective parts 252 and 268, which parts are discussed below.

The fastener of the present invention could use solid or hollow prongs 206. If the prongs 206 are hollow, an alternate to the back prongs 224 would be to have holes on back surface 222 corresponding to the hollow prongs. The fastening element 200 with such back holes could be mounted on a surface having pins which extend into the holes and stretch or compress the substrate to resist removal.

Turning now to FIG. 15 and continuing to view FIG. 14B, a base assembly according to the present invention will be discussed. FIG. 15 shows a cross-sectional side view in a horizontal plane of a base assembly according to the present invention except that the right side of the base member 240 is not shown in cross-section.

Before proceeding with a discussion of the base member 240 and associated components, it is noted that the invention may broadly be considered as an athletic contact device having a fastener attached thereto. As used herein, an "athletic contact device" shall include any object or article used for athletic competition and placed on, or adjacent to, an athletic field, court, or competitive zone such that athletes might be injured by colliding with the object during competition. For example, a bench or a sideline marker in football or soccer are athletic contact devices. Nets for ice hockey, field hockey, and lacross, goal posts, and fences separating competing athletes from spectators would be other examples. The present fastener could be used on any of these athletic contact devices to provide a severing function between the device and its support upon violent contact by an athlete, thereby minimizing the possibility of injury if an athlete collides into the device.

Base member 240 includes a polyvinyl cover 241 having foam 242, such as polyurethane, disposed therein. Several voids or air pockets 244 may be used within the foam 242. A grooved area including alternating ridges and channels as shown at 246 may be used at each of the four corners of the generally rectangular base 240. Disposed on the lower side of cover 241 is a peripheral portion 248 slanted up and inwardly as shown. Lower surface 250 of cover 241 includes a recessed channel 252 which extends in a square about locator socket 254. The recessed channel 252 includes ridges 252T and 252I respectively defining outer and inner boundaries of the channel 252. Disposed within the channel 252 are a number of fasteners 200 in accordance with the present invention. In particular, the recessed portion or channel 252 includes a series of back holes 256 into which the back prongs 224 of fasteners 200 may be inserted.

Continuing to view FIG. 15, a lower ground support 260 in accordance with the present invention will be discussed. Lower ground support 260 is secured to a ground plug, as at 86, in FIG. 8, for example. Preferably, support 260 includes a depending steel tube 262 which is inserted in a ground plug sleeve (not shown). The sleeve would be buried in the ground or cast in cement in the ground in accordance with techniques well known in the art. The steel tube 262 would thus hold the lower ground support 260 in a stationary position.

The steel tube 262 is attached as by welding to a metallic plate 264. Metallic plate 264 is square and generally planar except that it includes notches or corrugations 264R for gripping a molded rubber edge portion 266 which extends along all four sides of the square plate 264. Additionally, the plate 264 may include ribs or notches or corrugations 264G which provide space between the ground and plate 264 to accommodate the locking head studs 269.

Disposed within the confines of molded rubber edge portion 266 is a molded rubber piece or substrate 268 having a centrally disposed locator element 270 which is square in cross-section and fits within the locator socket 254 of base member 240. The rubber member 268 further includes numerous fastening elements 200 extending in a channel corresponding to channel 252 of base member 240. In particular, the prongs 206 extend between tapered edge 266E (which mates with 252T of lower surface 250 of base member 240) and tapered portion 268T which extends around locator element 270 and which mates with ridge 252I of lower surface or fact 250 of base member 240. The back prongs headed portions 230 space the rubber piece 268 from metal piece 264 whereas headed studs 269 hold rubber piece 268 to holes in metal plate 264.

In order to place base member 240 onto its lower ground support 260, locator socket 254 is placed on top of locator element 270 and the peripherally extending inwardly and upwardly slanting portion 266S of molded rubber edge 266 will be disposed below the square slanted mating portion 248 of base member 240. By simply lowering the base member 240, portions 252T and 252I of base member 240 will respectively mate with portions 266E and 268T such that the prongs 206 of base member 240 will line up within adjoining prongs of molded rubber piece 268. The prongs 206 of the base member 240 and ground support 260 will be in a semi-locked state, but will easily convert to a locked state by simply pushing the base member 240 downwardly until the top locking ridges 212 lock to the bottom locking ridges 214 of the opposing prongs in the manner shown and discussed above with reference to FIG. 14B.

Although the embodiment of FIG. 15 is similar in operation to the embodiment as discussed in the parent application with respect to FIG. 13, the use of the fastener constructed as described herein is highly advantageous in that it allows the base member 240 to very strongly grip the ground support 260 under normal operation, while allowing severance of this connection under very strong lateral forces. Specifically, the resiliency of the rubber mating prongs 206 allows the base member 240 to slightly yield under normal operation. However, when a high injury potential lateral force is directed towards the base member 240, the connection between numerous of the mating prongs 206 may be severed as the base member 240 buckles up to cushion the base runner sliding into the base. Under sufficiently high force, the base member 240 may completely sever its connection to support 260.

The slanting of the surface 266S of the rubber edge 266 is such that a lateral force directed towards the base member 240 will tend to cause the base member 240 to move upwardly and sever the connections between the mating prongs 206. However, if this upwardly directed force caused by the lateral force of the base runners sliding is of insufficient magnitude the locking ridges of the mating prongs 206 will prevent the base 240 from severing its connection to the ground support 260.

An important aspect of the construction of FIG. 15 is the ability of substrate 222 to flex which allows some of the prongs 206 to unlock although other prongs 206 of the same fastener may remain locked. This flexing of substrate 222 is greatly facilitated by the use of back prongs 224 to secure the fastening elements 200 to the surfaces of channel 252 and rubber piece 268.

As an alternate to the construction shown in FIG. 15, a rubber piece similar to rubber molding 268 would integrally include connecting prongs 206 and back prongs 224 which would be inserted into holes in plate 264. If desired, the fastening elements 200 could be arrayed on the base member 240 and rubber piece 268 in patterns such as shown in FIGS. 12A–12E. Further, wire mesh reinforcing could be used within the locator element 270.

In addition to its usefulness in achieving the safety base of the present invention, the fastener of the present invention is useful for numerous other applications. For example, it could be used for a quick release strap fastener. Additionally, since the fastener will properly work even when it is exposed to water, the fastener of the present invention may be used for boots for water-skiers, straps for scuba divers' oxygen tanks, and similar applications where water is to be expected. Further, the fastener of the present invention is useful for fastening pads for movable equipment and numerous other applications.

Although specific constructions and materials have been identified herein, it is to be appreciated that these are for illustrative purposes only. Various modifications and adaptations will be apparent to those of ordinary skill in the art. Accordingly, the scope of the present invention should be determined be reference to the claims appended hereto.

I claim:

1. A fastening element comprising:
(a) a substrate having first and second surfaces on opposite sides thereof, and
(b) a plurality of resilient connecting prongs projecting from said first surface, each connecting prong having
(i) a peripherally-extending top locking ridge,
(ii) a peripherally-extending bottom locking ridge larger than said top locking ridge,
(iii) a peripherally-extending upper recess disposed between said top locking ridge and said bottom locking ridge, and
(iv) a peripherally-extending locking recess larger than said upper recess and disposed between said bottom locking ridge and said first surface.

2. A fastener comprising first and second fastening elements constructed as in claim 1 and adapted to fasten to each other with top locking ridges of said first element being locked to bottom locking ridges of the second element.

3. The fastener of claim 2 further comprising a base member having said first fastening element attached thereto, and a lower ground support having said second fastening element attached thereto to secure said base member to said lower ground support such that said fasteners will totally sever apart when said base member is subject to a lateral force greater than an injury-potential threshold lateral force.

4. The invention of claim 2 wherein said second surface is secured to an athletic contact device.

5. The invention of claim 2 wherein each of said prongs includes a peripherally-extending substrate ridge disposed between said lower recess and said first surface.

6. The invention of claim 5 wherein each of said prongs is rotationally symmetric and each of said prongs includes a tapered head portion.

7. The invention of claim 6 wherein said bottom locking ridge of each of said prongs is tapered downwardly and outwardly.

8. A fastening element comprising:
a first substrate, having first and second surfaces and a plurality of resilient connecting prongs projecting from said first surface, each connecting prong having a peripherally-extending top locking ridge, a peripherally-extending bottom locking ridge larger than said top locking ridge, a peripherally-extending upper recess disposed between said top locking ridge and said bottom locking ridge, and a peripherally-extending lower recess larger than said upper recess and disposed between said bottom locking ridge and said first surface, and
wherein the prongs of said first substrate are adapted to be severably fastened to like prongs of a severable article.

9. The fastener of claim 8 wherein said first substrate includes a plurality of back prongs projecting from said second surface, each back prong having a peripherally-extending locking edge and a peripherally-extending recessed portion and adapted to be mounted to a face of a support with said second surface conforming to the face and each back prong locking edge locking its back prong in a hole in said face.

10. The invention of claim 9 further comprising a support element having a face, said first substrate being mounted to said face of said support element with each back prong locked in a hole in said face by its locking edge.

11. The invention of claim 10 wherein said article is an athletic contact device and includes a plurality of resilient connecting prongs so constructed and arranged so as to lockingly engage the connecting prongs projecting from said first surface.

12. A base member having a first fastening element attached thereto, a lower ground support having a second fastening element attached thereto, each said first and said second fastening elements including:
a substrate with first and second surfaces, and a plurality of resilient connecting prongs projecting from said first surface, each connecting prong having
a peripherally-extending top locking ridge,
a peripherally-extending bottom locking ridge larger than said top locking ridge,
a peripherally-extending upper recess disposted between said top locking ridge and said bottom locking ridge, and
a peripherally-extending lower recess larger than said upper recess and disposed between said bottom locking ridge and said first surface, and
wherein said first fastening element and second fastening element are attachable together upon cooperative engagement of said prongs to secure said base member to said lower ground support.

13. The invention of claim 12 wherein said base member has a lower surface with a peripheral portion slanted up and inwardly and said ground support has a peripheral portion slanted up and inwardly for mating with said peripheral portion of said base member.

14. An athletic contact device for minimizing the possibility of injury to a participating athlete, said device having a first fastening element attached thereto, said first fastening element including:
(a) a substrate with first and second surfaces, said first surface being planar, and
(b) a plurality of resilient connecting prongs projecting from said first surface, each connecting prong having
(i) a peripherally-extending top locking ridge,
(ii) a peripherally-extending bottom locking ridge,
(iii) a peripherally-extending upper recess disposed between said top locking ridge and said bottom locking ridge, and (iv) a peripherally-extending lower recess disposed between said bottom locking ridge and said first surface, said lower recess being larger than said upper recess and said bottom ridge being larger than said top ridge and wherein said athletic contact device is adapted to be severably fastened to a support by complete engagement of said first fastening element to a second fastening element on said support such that the resilience of said connecting prongs allows slight movement and springing back of said athletic contact device relative to the support under relatively low force and severance of the connecting between said athletic contact device and the support upon a participant applying relatively high force above an injury-potential threshold force.

15. The invention of claim 14 further comprising:

a lower ground support having a second fastening element, and wherein said first fastening element is fastened to said second fastening element so as to severably fasten said athletic contact device to said lower ground support.

16. The invention of claim 14 wherein said first fastening element is a unisex element adapted to fasten to a like-constructed element with top locking ridges of each element being locked to bottom locking ridges of the other element.

17. The invention of claim 16 wherein each of said connecting prongs further includes a peripherally-extending substrate ridge disposed between said lower recess and said substrate.

18. The invention of claim 14 wherein said athletic contact device is a base member, and further comprising a lower ground support having a second fastening element attached thereto, said second fastening element including:

a substrate having first and second surfaces and a plurality of resilient connecting prongs projecting from said first surface, each connecting prong having:

a peripherally-extending top locking ridge, a peripherally-extending bottom locking ridge, a peripherally-extending upper recess disposed between said top locking ridge and said bottom locking ridge, and a peripherally-extending lower recess disposed between said bottom locking ridge and said first surface, and wherein said first fastening element and second fastening element are attachable to secure said base member to said lower ground support such that said fasteners will totally sever apart when said base member is subject to a lateral force greater than an injury-potential threshold lateral force.

19. The invention of claim 14 wherein the bottom locking ridges of each of said prongs are tapered downwardly and outwardly.

20. An athletic contact device having a first fastening element attached thereto, said first fastening element including:

(a) a substrate with first and second surfaces, said first surface being planar, and (b) a plurality of resilient connecting prongs projecting from said first surface, each connecting prong having (i) a peripherally-extending top locking ridge, (ii) a peripherally-extending bottom locking ridge, (iii) a peripherally-extending upper recess disposed between said top locking ridge and said bottom locking ridge, and (iv) a peripherally-extending lower recess disposed between said bottom locking ridge and said first surface, and wherein said athletic contact device is adapted to the severably fastened to a support by said first fastening element such that the resilience of said connecting prongs allows slight movement of said athletic contact device relative to the support under relatively low force and severance of the connection between said athletic contact device and the support under relatively high force, wherein said athletic contact device is a base member, and further comprising a lower ground support having a second fastening element attached thereto, said second fastening element including:

a substrate having first and second surfaces and a plurality of resilient connecting prongs projecting from said first surface, each connecting prong having:

a peripherally-extending top locking ridge, a peripherally-extending bottom locking ridge, a peripherally-extending upper recess disposed between said top locking ridge and said bottom locking ridge, and a peripherally-extending lower recess disposed between said bottom locking ridge and said first surface and wherein said first fastening element and second fastening element are attachable to secure said base member to said lower ground support such that said fasteners will totally sever apart when said base member is subject to a lateral force greater than an injury-potential threshold lateral force, and wherein, for said first and second fastening elements, said lower recesses are larger than said upper recesses and said bottom ridges are larger than said top ridges.

21. An athletic contact device having a first fastening element attached thereto, said first fastening element including:

(a) a substrate with first and second surfaces, said first surface being planar, and (b) a plurality of resilient connecting prongs projecting from said first surface, each connecting prong having (i) a peripherally-extending top locking ridge, (ii) a peripherally-extending bottom locking ridge, (iii) a peripherally-extending upper recess disposed between said top locking ridge and said bottom locking ridge, and (iv) a peripherally-extending lower recess disposed between said bottom locking ridge and said first surface, and wherein said athletic contact device is adapted to be severably fastened to a support by said first fastening element such that the resilience of said connecting prongs allows slight movement of said athletic contact device relative to the support under relatively low force and severance of the connection between said athletic contact device and the support under relatively high force, wherein said athletic contact device is a base member, and further comprising a lower ground support having a second fastening element attached thereto, said second fastening element including:

a substrate having first and second surfaces and a plurality of resilient connecting prongs projecting from said first surface, each connecting prong having:

a peripherally-extending top locking ridge, a peripherally-extending bottom locking ridge, a peripherally-extending upper recess disposed between said top locking ridge and said bottom locking ridge, and a peripherally-extending lower recess disposed between said bottom locking ridge and said first surface and wherein said first fastening element and second fastening element are attachable to secure said base member to said lower ground support such that fasteners will totally sever apart when said base member is subject to a lateral force greater than an injury-potential threshold lateral force, and wherein said first fastening element includes a plurality of back prongs projecting from said second surface, each back prong having a peripherally-extending locking edge and peripherally-extending recessed portion and said first fastener is mounted to a face of said base member with each back prong locking edge locking its back prong in a hole in said face.

22. An athletic contact device having a first fastening element attached thereto, said first fastening element including:

(a) a substrate with first and second surfaces, said first surface being planar, and (b) a plurality of resilient connecting prongs projecting from said first surface, each connecting prong having (i) a peripherally-extending top locking ridge, (ii) a peripherally-extending bottom locking ridge, (iii) a peripherally-extending upper recess disposed between said top locking ridge and said bottom locking ridge, and (iv) a peripherally-extending lower recess disposed between said bottom locking ridge and said first surface, and wherein said athletic contact device is adapted to be severably fastened to a support by said first fastening element such that the resilience of said connecting prongs allows slight movement of said athletic contact device relative to the support under relatively low force and severance of the connection between said athletic contact device and the support under relatively high force, wherein said athletic contact device is a base member, and further comprising a lower ground support having a second fastening element attached thereto, said second fastening element including:

a substrate having first and second surfaces and a plurality of resilient connecting prongs projecting from said first surface, each connecting prong having:

a peripherally-extending top locking ridge, a peripherally-extending bottom locking ridge, a peripherally-extending upper recess disposed between said top locking ridge and said bottom locking ridge, and a peripherally-extending lower recess disposed between said bottom locking ridge and said first surface and wherein said first fastening element and second fastening element are attachable to secure said base member to said lower ground support such that said fasteners will totally sever apart when said base member is subject to a lateral force greater than an injury-potential threshold lateral force, and wherein each of said connecting prongs includes a tapered head portion and is rotationally symmetric.

23. An athletic contact device having a first fastening element attached thereto, said first fastening element including:

(a) a substrate with first and second surfaces, said first surface being planar, and (b) a plurality of resilient connecting prongs projecting from said first surface, each connecting prong having (i) a peripherally-extending top locking ridge, (ii) a peripherally-extending bottom locking ridge, (iii) a peripherally-extending upper recess disposed between said top locking ridge and said bottom locking ridge, and (iv) a peripherally-extending lower recess disposed between said bottom locking ridge and said first surface, and wherein said athletic contact device is adapted to be severably fastened to a support by said first fastening element such that the resilience of said connecting prongs allows slight movement of said athletic contact device relative to the support under relatively low force and severance of the connection between said athletic contact device and the support under relatively high force, wherein said athletic contact device is a base member, and further comprising a lower ground support having a second fastening element attached thereto, said second fastening element including:

a substrate having first and second surfaces and a plurality of resilient connecting prongs projecting from said first surface, each connecting prong having:

a peripherally-extending top locking ridge, a peripherally-extending bottom locking ridge, a peripherally-extending upper recess disposed between said top locking ridge and said bottom locking ridge, and a peripherally-extending lower recess disposed between said bottom locking ridge and said first surface and wherein said first fastening element and second fastening element are attachable to secure said base member to said lower ground support such that said fasteners will totally sever apart when said base member is subject to a lateral force greater than an injury-potential threshold lateral force, and wherein said base member has lower surface with a peripheral portion slanted up and inwardly and said ground support has a peripheral portion slanted up and inwardly for mating with said peripheral portion of said base member.

24. The invention of claim 23 wherein said ground support includes a metallic plate having a rubber edge molding extending around its periphery.

25. An athletic contact device having a first fastening element attached thereto, said first fastening element including:

(a) a substrate with first and second surfaces, said first surface being planar, and (b) a plurality of resilient connecting prongs projecting from said first surface, each connecting prong having (i) a peripherally-extending top locking ridge, (ii) a peripherally-extending bottom locking ridge, (iii) a peripherally-extending upper recess disposed between said top locking ridge and said bottom locking ridge, and (iv) a peripherally-extending lower recess disposed between said bottom locking ridge and said first surface, and wherein said athletic contact device is adapted to be severably fastened to a support by said first fastening element such that the resilience of said connecting prongs allows slight movement of said athletic contact device relative to the support under relatively low force and severance of the connection between said athletic contact device and the support under relatively high force, wherein, for each of said first and second fastening elements, said bottom locking ridges are larger than said top locking ridges and said lower recesses are larger than said upper recesses.

* * * * *